US012509861B2

(12) United States Patent
Torres Montalvo et al.

(10) Patent No.: US 12,509,861 B2
(45) Date of Patent: Dec. 30, 2025

(54) ADAPTER AND WEAR ELEMENT WITH A PIN ARRANGED AT A LOW STRESS POINT

(71) Applicant: METALOGENIA RESEARCH & TECHNOLOGIES S.L., Barcelona (ES)

(72) Inventors: Raul Torres Montalvo, Barcelona (ES); Albert Gimeno Tordera, Barcelona (ES); Fermín Sánchez Guisado, Premià de Mar (ES)

(73) Assignee: METALOGENIA RESEARCH & TECHNOLOGIES S.L., Barcelona (ES)

( * ) Notice: Subject to any disclaimer, the term of this patent is extended or adjusted under 35 U.S.C. 154(b) by 438 days.

(21) Appl. No.: 18/015,793

(22) PCT Filed: Jun. 10, 2021

(86) PCT No.: PCT/EP2021/065625
§ 371 (c)(1),
(2) Date: Jan. 12, 2023

(87) PCT Pub. No.: WO2022/012819
PCT Pub. Date: Jan. 20, 2022

(65) Prior Publication Data

US 2023/0272601 A1 Aug. 31, 2023

(30) Foreign Application Priority Data

Jul. 17, 2020 (EP) ..... 20382649

(51) Int. Cl.
*E02F 9/28* (2006.01)

(52) U.S. Cl.
CPC ..... *E02F 9/2825* (2013.01); *E02F 9/2858* (2013.01)

(58) Field of Classification Search
None
See application file for complete search history.

(56) References Cited

U.S. PATENT DOCUMENTS 5,918,391 A * 7/1999 Vinas Peya ..... E02F 9/2833 37/456
2017/0321396 A1* 11/2017 Zenier ..... E02F 9/2883

FOREIGN PATENT DOCUMENTS

CN 202644641 U 1/2013
EP 1710358 A1 10/2006
(Continued)

OTHER PUBLICATIONS

International Search Report, PCT/EP2021/065625, Mailed Sep. 23, 2021.

*Primary Examiner* — Christopher J Sebesta
*Assistant Examiner* — Alfred H Tsui
(74) *Attorney, Agent, or Firm* — Calderone McKay LLC

(57) ABSTRACT

The invention relates to an adapter and a wear element of a shovel of an earth moving machine attached to one another by means of a pin, wherein the pin is positioned at a point such that, as there is relative rotation between the wear element and the adapter, due to the application of both a force according to direction Y applied on a point B1 and directed towards a point B2 and a force according to direction Y applied on point B2 and directed towards point B1, the support surfaces of the adapter and of the wear element contact one another before the pin is subjected to stresses. The stresses the pin must withstand are thereby reduced.

18 Claims, 8 Drawing Sheets

(56) References Cited

FOREIGN PATENT DOCUMENTS

| | | | | |
|---|---|---|---|---|
| EP | 2620557 | A1 | 10/2021 | |
| KR | 20160147866 | A | 12/2016 | |
| WO | 2011029157 | A1 | 3/2011 | |
| WO | WO-2015011012 | A1 * | 1/2015 | ..... E02F 9/2825 |

* cited by examiner

ADAPTER AND WEAR ELEMENT WITH A PIN ARRANGED AT A LOW STRESS POINT

FIELD OF THE INVENTION

The invention relates to an adapter for supporting a wear element of a shovel of an earth moving machine, wherein:

the adapter has a rear part suitable for being fixed to the shovel, and a front part suitable for being housed inside a cavity of the wear element, wherein the adapter defines a longitudinal axis X, has at least one pin opening suitable for housing a pin suitable for retaining the wear element on the adapter, wherein the pin has a pre-established location with respect to the pin opening and has a longitudinal axis defining an axis Z, wherein axis X and axis Z define a plane XZ and a direction perpendicular to plane XZ, defining an axis Y, and axis X and axis Y define a plane XY, has at least one front upper support surface, at least one rear upper support surface, at least one front lower support surface, and at least one rear lower support surface, the upper support surfaces and the lower support surfaces are symmetrical to one another with respect to plane XZ, in a longitudinal section according to plane XY, the following is defined:

a point A1 which is the rear end of the intersection of the rear upper support surface with plane XY or, if there is more than one rear upper support surface, it is the projection according to Z on plane XY of the most rearward end of all the rear upper support surfaces, a point A2 which is the rear end of the intersection of the rear lower support surface with plane XY or, if there is more than one rear lower support surface, it is the projection according to Z on plane XY of the most rearward end of all the rear lower support surfaces, a point B1 which is the front end of the intersection of the front upper support surface with plane XY or, if there is more than one front upper support surface, it is the projection according to Z on plane XY of the most forward end of all the front upper support surfaces, a point B2 which is the front end of the intersection of the front lower support surface with plane XY or, if there is more than one front lower support surface, it is the projection according to Z on plane XY of the most forward end of all the front lower support surfaces, wherein between A1 and A2 there is a distance H2 in direction Y, and between B1 and B2 there is a distance H1 in direction Y, wherein when the wear element is assembled on the adapter, there is a clearance, in the direction of axis Y, between any of points A1, A2, B1, and B2 and the wear element with a predetermined value j, wherein between A1 and B1 there is a distance D in direction X.

The invention also relates to a wear element suitable for being assembled on an adapter of a shovel of an earth moving machine, wherein:

the wear element has a front part suitable for cutting into the earth to be moved, and a rear part with a cavity suitable for housing therein a front part of the adapter, wherein the wear element defines a longitudinal axis X, has at least one through opening on one side of the cavity, suitable for housing a pin suitable for retaining the wear element on the adapter, wherein the pin has a pre-established location with respect to the through opening and has a longitudinal axis defining an axis Z, cavity (and preferably has two through openings aligned with one another and on each of the sides of the cavity, each of them suitable for housing a pin, or else a pin extending from one through opening to the other), wherein axis X and axis Z define a plane XZ and a direction perpendicular to plane XZ, defining an axis Y, and axis X and axis Y define a plane XY, has at least one front upper support surface, at least one rear upper support surface, at least one front lower support surface, and at least one rear lower support surface, the upper support surfaces and the lower support surfaces are symmetrical to one another with respect to plane XZ, in a longitudinal section according to plane XY, the following is defined:

a point a1 which is the rear end of the intersection of the rear upper support surface with plane XY or, if there is more than one rear upper support surface, it is the projection according to Z on plane XY of the most rearward end of all the rear upper support surfaces, a point a2 which is the rear end of the intersection of the rear lower support surface with plane XY or, if there is more than one rear lower support surface, it is the projection according to Z on plane XY of the most rearward end of all the rear lower support surfaces, a point b1 which is the front end of the intersection of the front upper support surface with plane XY or, if there is more than one front upper support surface, it is the projection according to Z on plane XY of the most forward end of all the front upper support surfaces, a point b2 which is the front end of the intersection of the front lower support surface with plane XY or, if there is more than one front lower support surface, it is the projection according to Z on plane XY of the most forward end of all the front lower support surfaces, wherein between a1 and a2 there is a distance h2 in direction Y, and between b1 and b2 there is a distance h1 in direction Y, wherein when the wear element is assembled on the adapter, there is a clearance, in the direction of axis Y, between any of points a1, a2, b1, and b2 and the adapter with a predetermined value j, wherein between a1 and b1 there is a distance d in direction X.

The invention also relates to an assembly formed by an adapter and a wear element, both according to the invention.

The invention also relates to methods of designing and manufacturing an adapter for supporting a wear element of a shovel of an earth moving machine, wherein:

the adapter has a rear part suitable for being fixed to the shovel, and a front part suitable for being housed inside a cavity of the wear element, wherein the adapter defines a longitudinal axis X, the method comprising a step of locating at least one pin opening suitable for housing a pin suitable for retaining the wear element on the adapter, wherein the pin has a longitudinal axis defining an axis Z, wherein axis X and axis Z define a plane XZ and a direction perpendicular to plane XZ, defining an axis Y, and axis X and axis Y define a plane XY, wherein the adapter has at least one front upper support surface, at least one rear upper support surface, at least one front lower support surface, and at least one rear lower support surface, wherein the upper support surfaces and the lower support surfaces are symmetrical to one another with respect to plane XZ.

Finally, the invention also relates to methods of designing and manufacturing a wear element suitable for being assembled on an adapter of a shovel of an earth moving machine, wherein:

the wear element has a front part suitable for cutting into the earth to be moved, and a rear part with a cavity suitable for housing therein a front part of the adapter, wherein the wear element defines a longitudinal axis X, the method comprising a step of locating the through opening on one side of the cavity, suitable for housing a pin suitable for retaining the wear element on the adapter, wherein the pin has a longitudinal axis defining an axis Z (and preferably a step of locating two through openings, aligned with one another and on each of the sides of the cavity, any given one of them suitable for housing a pin or else suitable for housing a pin extending from one of them to the other), wherein axis X and axis Z define a plane XZ and a direction perpendicular to plane XZ, defining an axis Y, and axis X and axis Y define a plane XY, wherein the wear element has at least one front upper support surface, at least one rear upper support surface, at least one front lower support surface, and at least one rear lower support surface, wherein the upper support surfaces and the lower support surfaces are symmetrical to one another with respect to plane XZ.

Preferably the wear element is a tooth. In general, these wear assemblies comprise a female part, having a cavity, and a male part, having a part suitable for being housed in the cavity. In the present description and claims, the female part is considered to be the wear element and the male part is considered to be the adapter. The front part of the male part housed inside the cavity is also referred to as the nose of the adapter. However, the wear assembly could be the opposite, that is, the female part being the adapter and the male part being the wear element. The invention would be applied exactly the same way, and this alternative must therefore also be understood as being part of the invention.

The present description and claims describe an adapter and a wear element which, even though they are independent parts, their function is to be attached to one another as a result of pin. The adapter is in turn attached to a shovel of an earth moving machine. Given that each of these elements is intended for being part of an assembly, the characteristics of one of them (in particular its physical dimensions) affect the others, to the extent that they are baseline data for the design of the remaining elements. In general, in patents and, in particular in the independent claims of a patent, it is allowable to define the dimensions and/or the shape of a first element by means of a general reference to the dimensions or to the corresponding shape of a second element that is not part of the product protected by the independent claim, if both elements are related to one another through use. The designer of these assemblies will have a series of defined elements, in particular contour heights, which must be taken into account when designing each of the components of the assembly, regardless of the fact that these contour heights are the contour heights of the component in question or of other elements of the assembly, or even general contour heights of the assembly as such. Thus, for example, in the present case the z axis is the position that will be occupied by the axis of the pin in the assembled position of the assembly. Neither the adapter nor the wear element incorporates the pin and, however, the future position thereof is certainly a contour height which is present at the time of designing both the adapter and the wear element. Therefore, this contour height is part of the adapter (and of the wear element) as is any other contour height thereof.

When designing a wear assembly, the existence of areas in which the adapter and the wear element should contact one another is contemplated. These areas are referred to as support surfaces in the present description and claims the assembly is designed for the forces and reactions to be transmitted between the adapter and the wear element through these support surfaces. It is possible that during use, in particular when the assembly has sustained deformations and wear due to use and/or is filled with fines, the adapter and the wear element are actually in contact in areas that are not the contact surfaces and, therefore, it is possible that the transmission of forces and reactions does not take place only through the support surfaces. However, this is not in contradiction with the fact that both the adapter and the wear element have previously defined support surfaces which, therefore, are part of their characteristic elements. In the present description and claims, some of these support surfaces have been described as "upper" or "lower". These terms only make reference to the orientation of the surface, with the upper surfaces being oriented upwardly. In the case of wear assemblies without lugs, there is certain coincidence in the sense that the upper support surfaces (i.e., those that are oriented upwardly) are precisely the support surfaces that are in the upper part of the component in question (the adapter or the wear element). However, as will be seen below, in the case of assemblies with lugs there are upper support surfaces (oriented upwardly) which, in fact, are in the lower part of the component, and vice versa.

State of the Art

Wear assemblies formed by an adapter with a pin opening and a wear element with two openings aligned with one another, such that they coincide, at least partially, with the pin opening of the adapter in the assembled position and are attached to one another as a result of a pin housed in the openings and the pin opening, are known. Examples of these assemblies can be found in documents WO 2011029157, EP 2 620 557 A1, and EP 1 710 358. In general, several groups of fasteners can be found:

Group 1: the pin opening of the adapter is a through opening, and the wear element has two through openings. In the assembled position, a single pin extends from end to end, through the three openings.

Group 2: the pin opening of the adapter is a through opening (like in the preceding group), but two pins are used, each of them occupying part of the pin opening of the adapter and one of the through openings of the wear element.

Group 3: the adapter has two pin openings, which are blind openings and are aligned with one another, and two pins are used. Each pin is housed in one of the pin openings and in one of the through openings of the wear element.

Group 4: the wear element has only one through opening and the adapter has a single pin opening, which is a blind opening, and by means of a single pin, the wear element is fixed to the adapter in an asymmetrical manner with respect to plane XY.

The present invention is compatible with any of these 4 groups of alternatives, although the alternatives of groups 1, 2, and 3 are particularly advantageous.

In general, it is of interest for the pin not to be subjected to stresses (it must only retain the wear element so that it does not come out due to gravity). However, the reality is that the pin is subjected to stresses, wear and deformations, which can cause difficulties when disassembling the wear element, breaking of the pin, etc. Therefore, there is a need to offer new designs which fix or at least reduce the loads and deformations to which the pin is subjected.

DESCRIPTION OF THE INVENTION

The invention has the object of overcoming these drawbacks. This purpose is achieved by means of an adapter of the type indicated above, characterized in that axis Z passes through the inside of a circle arranged in the longitudinal section, with radius R and center C, wherein center c is arranged on axis X, wherein R2 is a radius with an origin at center C and end at A1, wherein A1j is a point arranged at a distance R2 from center C and at a distance from axis X, according to the direction of Y, equal to $$\frac{H2}{2} + j,$$

wherein R1 is a radius with an origin at center C and end at B1, wherein B1j is a point arranged at a distance R1 from center C and at a distance from axis X, according to the direction of Y, equal to $$\frac{H1}{2} + j,$$

wherein between A1 and C there is a distance A in direction X, and between B1 and C there is a distance B in direction X, and wherein if the adapter is for a wear element without lugs $$\arcsin\left(\frac{H1/2 + j}{R1}\right) - \arcsin\left(\frac{H1/2}{R1}\right) = \arcsin\left(\frac{H2/2 + j}{R2}\right) - \arcsin\left(\frac{H2/2}{R2}\right)$$

whereas if the adapter is for a wear element with lugs $$\arcsin\left(\frac{H1/2 + j}{R1}\right) - \arcsin\left(\frac{H1/2}{R1}\right) = \arcsin\left(\frac{H2/2}{R2}\right) - \arcsin\left(\frac{H2/2 - j}{R2}\right)$$

Preferably, axis Z, i.e., the position of the pin, passes through center C which, as will be discussed below, is the optimal position of the pin. However, in positions close to the center C, i.e., inside a circle with radius R, the obtained results can be satisfactory. In this sense, R has preferably a value less than 10% of the sum of distances A and B, and very preferably has a value less than 5% of the sum of distances A and B. It is particularly advantageous for R to have a value less than 2% of the sum of distances A and B.

Indeed, the strategy of the invention consists of positioning the pin at a point such that, as there is relative rotation between the wear element and the adapter, due to the application of both a force according to direction Y applied on point B1 and directed towards point B2 and a force according to direction Y applied on point B2 and directed towards point B1, the support surfaces of the adapter and of the wear element contact one another before the pin is subjected to stresses. The stresses the pin must withstand are thereby reduced. The advantage of this solution can be seen not only in the case of anew wear assembly but also throughout the entire service life thereof, i.e., when wear, deformations, accumulation of fines, etc., are gradually built up. Indeed, these "deviations from the original working conditions" usually cause the pin to be subjected to stresses that are even greater than what it is initially subjected to, causing deformations hindering its later removal and even breaking which, in turn, may cause the loss of the wear element. However, with the solution proposed in the present invention, the pin is subjected to much lower stresses, even throughout the entire service life of the wear assembly.

Preferably a hemispherical surface with center C and radius R1 extends between [a] the front end of the front upper support surface or, if there is more than one front upper support surface, between the front most forward end of all the front upper support surfaces, and [b] the front end of the front lower support surface or, if there is more than one front lower support surface, between the front most forward end of all the front lower support surfaces. As will be demonstrated in greater detail below, this front hemispherical surface allows sliding (as there is rotation around the pin) between the adapter and the wear element (which preferably also has an equivalent hemispherical surface) when there are forces applied according to direction Y.

Advantageously, the adapter comprises at least one upper secondary hemispherical surface, the center of which is at C, and one lower secondary hemispherical surface, the center of which is also at C. These secondary hemispherical surfaces, which are preferably complementary to equivalent secondary hemispherical surfaces in the wear element but with respect to which they have a predetermined separation, allow maintaining this separation constant (since all these surfaces have their center at the center of rotation). This separation is thereby prevented from increasing, which limits the entry of material, which in turn prevents a force which tends to separate the wear element from the adapter from increasing.

In general, the wear elements, in particular the teeth, can be split into two large groups, those with lugs and those without lugs. This difference will be discussed in greater detail below, but is a clear concept for one skilled in the art. The present invention is suitable for both cases (wear assemblies having wear elements with or without lugs), but preferably the adapter is for a wear element without lugs. In this latter case, it is advantageous for H2 to be greater than H1.

In general, the entire invention has been defined and explained considering contour heights and dimensions of the adapter (and, below, of the wear element) when it is new.

The invention also has as an object a wear element of the type indicated above characterized in that axis Z passes through the inside of a circle arranged in the longitudinal section, with radius r and center c, wherein center c is arranged on axis X, wherein r2 is a radius with an origin at center c and end at a1, wherein a1j is a point arranged at a distance r2 from center c and at a distance from axis X, according to the direction of Y, equal to $$\frac{h2}{2} - j,$$

wherein r1 is a radius with an origin at center c and end at b1, wherein b1j is a point arranged at a distance r1 from center c and at a distance from axis X, according to the direction of Y, equal to $$\frac{h1}{2} - j,$$

wherein between a1 and c there is a distance a in direction X, and between b1 and c there is a distance b in direction X, and wherein if the wear element is a wear element without lugs $$\arcsin\left(\frac{h1/2}{r1}\right) - \arcsin\left(\frac{h1/2 - j}{r1}\right) = \arcsin\left(\frac{h2/2}{r2}\right) - \arcsin\left(\frac{h2/2 - j}{r2}\right)$$

whereas if the wear element is a wear element with lugs $$\arcsin\left(\frac{h1/2}{r1}\right) - \arcsin\left(\frac{h1/2 - j}{r1}\right) = \arcsin\left(\frac{h2/2 + j}{r2}\right) - \arcsin\left(\frac{h2/2}{r2}\right)$$

In general, it must be taken into account that, in use, the wear element, the adapter, and the pin form an assembly that is used as such. However, the wear element suffers much more during use, so its mean service life is less than that of the adapter or the pin. Thus, for example, it is common for the mean service life of an adapter to be 3 to 5 times longer (or even more) than the mean service life of a tooth of the shovel of an earth moving machine. It is therefore common for the wear element to be fixed to the adapter in a manner such that it can be readily disassembled, usually by means of a pin, and for these three elements (wear elements, adapter, and pin) to be sold not only as assemblies formed by the three components (or by the adapter-wear element pair) but also separately, and it is necessary for the operations of changing out a used wear element with a new one to really be as quick, as simple, and as trouble-free as possible, which includes the pin not sustaining significant deformations and being easy to remove. It is therefore necessary to provide claims which protect the adapter and the wear element individually, because this is how said elements are usually found on the market. This has made it necessary to define the present invention independently for the adapter and for the wear element, even though the underlying concept is the same in both cases. Therefore, the attempt has been made to use, to the extent possible, the same references for equivalent points and contour heights between the adapter and the wear element, by simply replacing uppercase letters (for the adapter) with lowercase letters (for the wear element). The exception to this is the clearance j, which is common in both cases. In the mathematical formulas, changes have only been introduced precisely due to the change in the body of reference (adapter or wear element). In turn, the pin as such is not affected by the invention. Therefore, the explanation of the operation of the invention in regard to the wear element is the same as that of the adapter, as are the advantages thereof. For the purpose of avoiding unnecessary repetitions, they will not be repeated herein and those that are set forth above are valid.

Therefore, as indicated in the case of the adapter, the preferred embodiments of the wear element comprise:

- radius r having a value less than 10% of the sum of distances a and b, and preferably having a value less than 5% of the sum of distances a and b. It is particularly advantageous for it to have a value less than 2% of the sum of distances a and b.
- a hemispherical surface with center c and radius r1 extending between [a] the front end of the front upper support surface or, if there is more than one front upper support surface, between the front most forward end of all the front upper support surfaces, and [b] the front end of the front lower support surface or, if there is more than one front lower support surface, between the front most forward end of all the front lower support surfaces.
- comprising at least one upper secondary hemispherical surface, the center of which is at c, and one lower secondary hemispherical surface, the center of which is also at c.
- being a wear element without lugs, in which case it is particularly advantageous for h2 to be greater than h1.

The invention also has as an object an assembly formed by an adapter according to the invention and a wear element according to the invention. Preferably, the value of radius R1 is equal to the value of radius r1, which allows achieving sliding (by rotation) between the two previously indicated hemispherical surfaces. In fact, R1 being equal to r1 means that the distance between both hemispherical surfaces is nil, i.e., both hemispherical surfaces are in contact with one another. Furthermore, in this case, when B1 rotates around C, it ends up coinciding with b1.

The invention also has as an object a method of designing an adapter for supporting a wear element of a shovel of an earth moving machine of the type indicated above characterized in that:

- in a longitudinal section according to plane XY, the following is defined:
  - a point A1 which is the rear end of the intersection of the rear upper support surface with plane XY or, if there is more than one rear upper support surface, it is the projection according to Z on plane XY of the most rearward end of all the rear upper support surfaces,
  - a point A2 which is the rear end of the intersection of the rear lower support surface with plane XY or, if there is more than one rear lower support surface, it is the projection according to Z on plane XY of the most rearward end of all the rear lower support surfaces,
  - a point B1 which is the front end of the intersection of the front upper support surface with plane XY or, if there is more than one front upper support surface, it is the projection according to Z on plane XY of the most forward end of all the front upper support surfaces,
  - a point B2 which is the front end of the intersection of the front lower support surface with plane XY or, if there is more than one front lower support surface, it is the projection according to Z on plane XY of the most forward end of all the front lower support surfaces, wherein between A1 and A2 there is a distance H2 in direction Y, and between B1 and B2 there is a distance H1 in direction Y, wherein when the wear element is assembled on the adapter, there is a clearance, in the direction of axis Y, between any of points A1, A2, B1, and B2 and the wear element with a predetermined value j, wherein between A1 and B1 there is a distance D in direction X, and in that axis Z is positioned such that it passes through the inside of a circle arranged in the longitudinal section, with radius R and center C, wherein center c is arranged on axis X, wherein R2 is a radius with an origin at center C and end at A1, wherein A1j is a point arranged at a distance R2 from center C and at a distance from axis X, according to the direction of Y, equal to $$\frac{H2}{2}+j,$$

wherein R1 is a radius with an origin at center C and end at B1, wherein B1j is a point arranged at a distance R1 from center C and at a distance from axis X, according to the direction of Y, equal to $$\frac{H1}{2}+j,$$

wherein between A1 and C there is a distance A in direction X, and between B1 and C there is a distance B in direction X, and wherein if the adapter is for a wear element without lugs $$\arcsin\left(\frac{H1/2+j}{R1}\right)-\arcsin\left(\frac{H1/2}{R1}\right)=\arcsin\left(\frac{H2/2+j}{R2}\right)-\arcsin\left(\frac{H2/2}{R2}\right)$$

whereas if the adapter is for a wear element with lugs $$\arcsin\left(\frac{H1/2+j}{R1}\right)-\arcsin\left(\frac{H1/2}{R1}\right)=\arcsin\left(\frac{H2/2}{R2}\right)-\arcsin\left(\frac{H2/2-j}{R2}\right)$$

The invention also has as an object a method of manufacturing an adapter for supporting a wear element of a shovel of an earth moving machine of the type indicated above, characterized in that it comprises a step of designing an adapter according to the invention, a step of manufacturing a mold comprising the geometry suitable for forming the pin opening suitable for housing a pin suitable for retaining the wear element on the adapter, wherein the pin has a longitudinal axis defining axis Z, and a step of pouring molten material into the mold for obtaining the adapter.

Similarly, the invention also has as an object a method of designing a wear element suitable for being assembled on an adapter of a shovel of an earth moving machine of the type indicated above, characterized in that in a longitudinal section according to plane XY, the following is defined:

a point a1 which is the rear end of the intersection of the rear upper support surface with plane XY or, if there is more than one rear upper support surface, it is the projection according to Z on plane XY of the most rearward end of all the rear upper support surfaces, a point a2 which is the rear end of the intersection of the rear lower support surface with plane XY or, if there is more than one rear lower support surface, it is the projection according to Z on plane XY of the most rearward end of all the rear lower support surfaces, a point b1 which is the front end of the intersection of the front upper support surface with plane XY or, if there is more than one front upper support surface, it is the projection according to Z on plane XY of the most forward end of all the front upper support surfaces, a point b2 which is the front end of the intersection of the front lower support surface with plane XY or, if there is more than one front lower support surface, it is the projection according to Z on plane XY of the most forward end of all the front lower support surfaces, wherein between a1 and a2 there is a distance h2 in direction Y, and between b1 and b2 there is a distance h1 in direction Y, wherein when the wear element is assembled on the adapter, there is a clearance, in the direction of axis Y, between any of points a1, a2, b1, and b2 and the adapter with a predetermined value j, wherein between a1 and b1 there is a distance d in direction X, and in that axis Z is positioned to pass through the inside of a circle arranged in the longitudinal section, with radius r and center c, wherein center c is arranged on axis X, wherein r2 is a radius with an origin at center c and end at a1, wherein alj is a point arranged at a distance r2 from center c and at a distance from axis X, according to the direction of Y, equal to $$\frac{h2}{2}-j,$$

wherein r1 is a radius with an origin at center c and end at b1, wherein blj is a point arranged at a distance r1 from center c and at a distance from axis X, according to the direction of Y, equal to $$\frac{h1}{2}-j,$$

wherein between a1 and c there is a distance a in direction X, and between b1 and c there is a distance b in direction X, and wherein if the wear element is a wear element without lugs $$\arcsin\left(\frac{h1/2}{r1}\right)-\arcsin\left(\frac{h1/2-j}{r1}\right)=\arcsin\left(\frac{h2/2}{r2}\right)-\arcsin\left(\frac{h2/2-j}{r2}\right)$$

whereas if the wear element is a wear element with lugs $$\arcsin\left(\frac{h1/2}{r1}\right)-\arcsin\left(\frac{h1/2-j}{r1}\right)=\arcsin\left(\frac{h2/2+j}{r2}\right)-\arcsin\left(\frac{h2/2}{r2}\right)$$

Finally, the invention also has as an object a method of manufacturing a wear element suitable for being assembled on an adapter of a shovel of an earth moving machine of the type indicated above, characterized in that it comprises a step of designing a wear element according to the invention, a step of manufacturing a mold comprising the geometry suitable for forming the through opening suitable for housing a pin suitable for retaining the wear element on the adapter, wherein the pin has a longitudinal axis defining axis Z, and a step of pouring molten material into the mold for obtaining the wear element.

BRIEF DESCRIPTION OF THE DRAWINGS

Other advantages and features of the invention will become apparent from the following description in which preferred embodiments of the invention are described in a non-limiting manner in reference to the attached drawings. In the figures.

DETAILED DESCRIPTION OF EMBODIMENTS OF THE INVENTION

Figure 1:
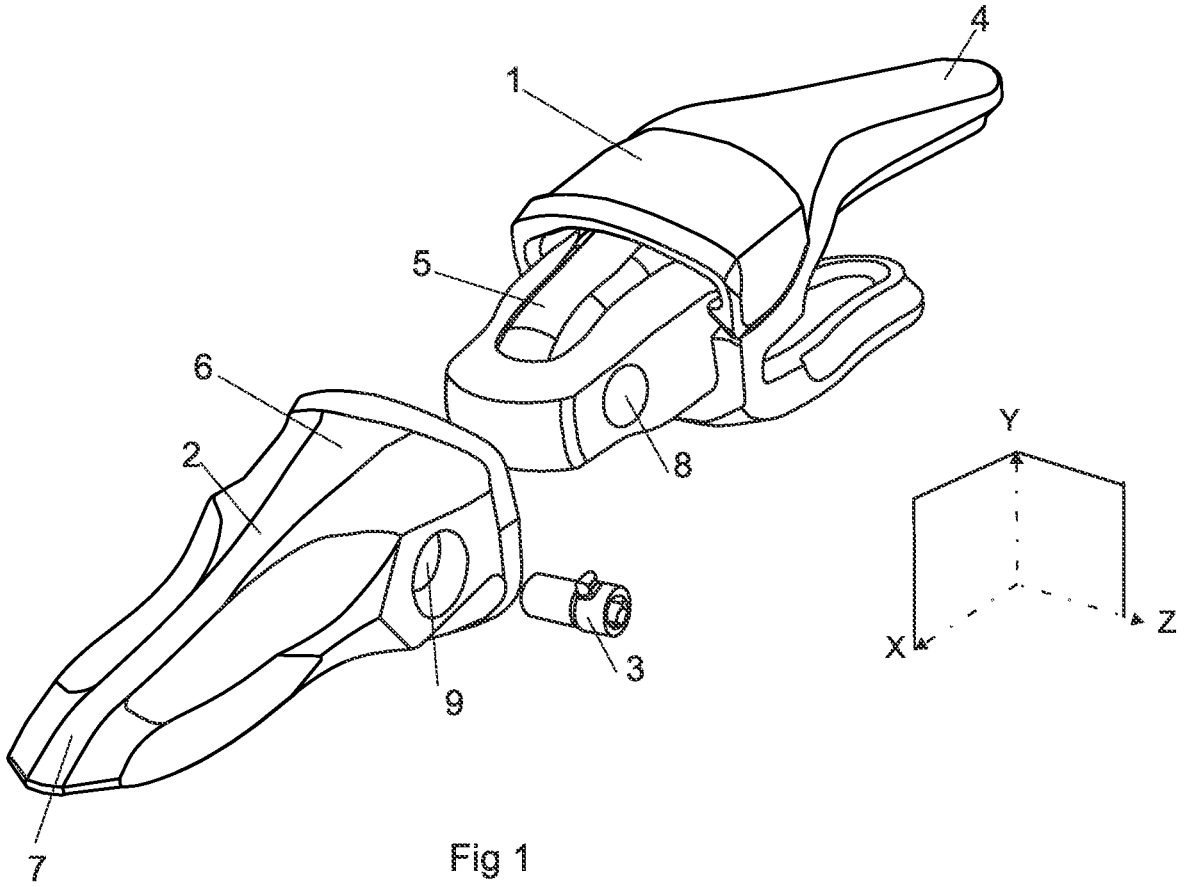
FIG. 1 shows a perspective view of a wear assembly formed by an adapter, a wear element, and a pin.

FIG. 1 shows an exploded general view of a wear assembly formed by an adapter 1, a wear element 2 (specifically a tooth, which is a preferred embodiment of the invention), and a pin 3. The adapter 1 has a rear part 4, whereby it is fixed to the shovel of an earth moving machine, and a front part 5, usually referred to as a nose, having a geometry suitable for being housed inside a cavity 10 present in the rear part 6 of the wear element 2. The adapter 1 has a pin opening 8 and the wear element 2 has two through openings 9, each of which goes through one of the walls sides surrounding the cavity 10. The pin opening 8 of the adapter 1 and the through openings 9 of the wear element 2 are arranged such that, in the assembled position of the wear element 2 on the adapter 1, the pin opening 8 and the two through openings 9 are aligned with one another, or at least partially aligned, since they do not necessarily have to have exactly the same cross-section. However, the partial alignment must be sufficient so that, in the assembled position, a pin 3 may be in the pin opening 8 of the adapter 1 and project therefrom, being introduced into the through openings 9 of the wear element 2 by a sufficient amount to enable exerting its locking function.

The adapter 1 defines a main direction between its front part 5 and its rear part 4. This main direction thus defines a longitudinal axis X. In turn, the pin opening 8 in which the pin 3 will be housed also defines a main direction which is perpendicular to axis X. This second main direction thus defines an axis Z. Both axes define a plane XZ and a direction perpendicular thereto, defining an axis Y.

The same occurs with the wear element 2: its front part 7 and its rear part 6 define an axis X, the through openings 9 thereof (which are aligned with one another) define an axis Z, and the direction perpendicular to the corresponding plane XZ defines an axis Y. Furthermore, in the assembled position axes XYZ of the adapter 1 and axes XYZ of the wear element 2 coincide.

In general, the front part 5 of the adapter 1 and the cavity 10 of the wear element 2 have more or less complex geometries. Usually these geometries are designed such that there is not complete contact between the entire surface of the front part 5 of the adapter 1 and the cavity 10, but rather it is envisaged that the contact will be on specific support surfaces clearly defined in the design step. The forces and reactions are transmitted between the adapter 1 and the wear element 2 through these support surfaces. As discussed above, during use of the wear assembly and due to wear, the deformations and the introduction of material between the gaps of the assembly, the actual situation may be more complex, but it is not in contradiction with the fact that both the adapter 1 and the wear element 2 have, as their own characteristic elements, the mentioned support surfaces.

In regard to the present invention, forces and reactions according to axis Y (or components according to axis Y thereof) are taken into account, so it is of interest to provide support surfaces that are capable of transmitting forces in this direction, even though these surfaces do not have to be completely planar or perfectly oriented such that they are perpendicular to Y. In general, these forces and reactions will tend to cause the wear element 2 to rotate with respect to the adapter 1 around an axis parallel to Z. An upper part (in the top part in FIG. 1) and a lower part as well as a front part (to the left in FIG. 1) and a rear part of both the adapter 1 and the wear element 2 can be defined using this axis Z.

Figure 2:
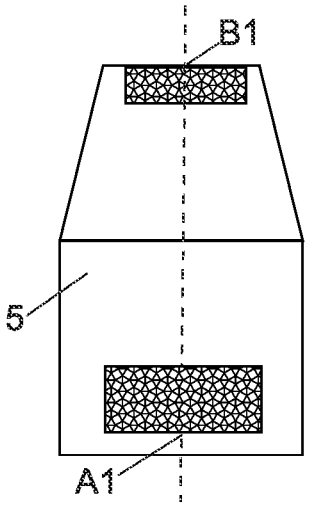
FIGS. 2 to 4 show schematic top plan views of adapters with support surfaces that are marked.
Figure 3:
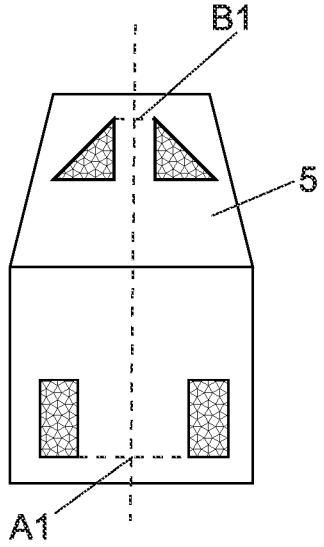
Figure 4:
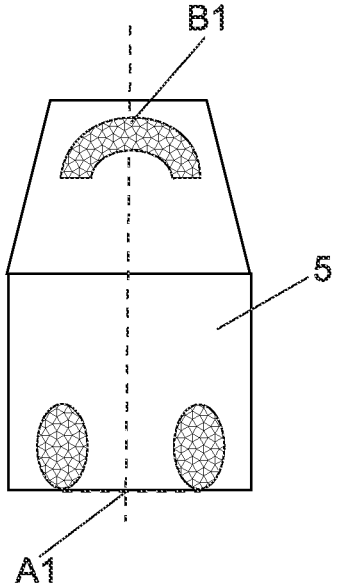

Both the adapter 1 and the wear element 2 must have at least one front upper support surface, one rear upper support surface, one front lower support surface, and one rear lower support surface. These surfaces can have various geometries, and there may be more than one of them (for example, two rear support surfaces, that is, both the upper and the lower rear support surfaces). FIGS. 2 to 4 show several schematic examples. Adapters seen "from above" (according to direction Y) with upper support surfaces being marked are depicted in a highly schematic manner in these figures. The intersection with a plane XY has also been marked. There may be one or more than one upper support surface in each front and rear area. Naturally, there may be other shapes (the actual shapes are usually more complex) and they can be mixed in any way (for example, the front upper surface of FIG. 2 with the rear upper surfaces of FIG. 4, etc.). The exact same situation may occur in the wear element 2.

For the present invention, the points which allow defining these support surfaces are also important:

point A1 which is the rear end of the intersection of the rear upper support surface with plane XY or, if there is more than one rear upper support surface, it is the projection according to Z on plane XY of the most rearward end of all the rear upper support surfaces point B1 which is the front end of the intersection of the front upper support surface with plane XY or, if there is more than one front upper support surface, it is the projection according to Z on plane XY of the most forward end of all the front upper support surfaces.

Points A2 and B2 arranged in the lower part of the adapter 1 are similarly defined. Likewise, points a1, a2, b1, and b2 of the wear element 2 can similarly be defined.

Figure 5:
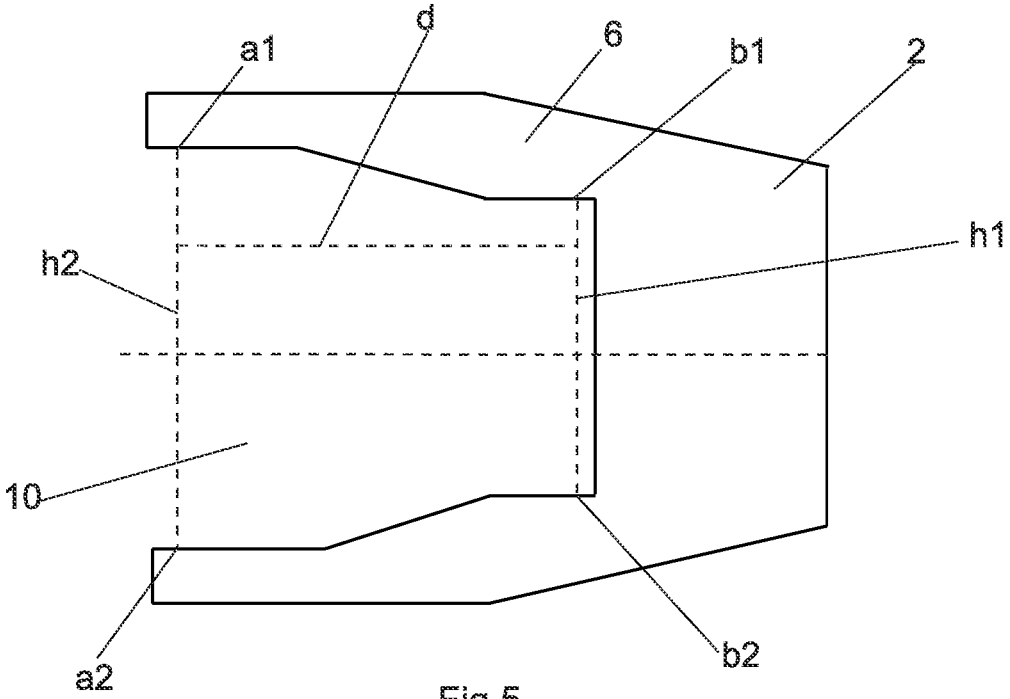
FIG. 5 shows a schematic view of a section according to plane XY of a wear element.

FIG. 5 shows a longitudinal section, according to plane XY, of a wear element 2. It has points a1, a2, b1, and b2 marked. These points define distances h1, h2, and d. Distances H1, H2, and D are defined in an equivalent manner for the adapter 1.

Figure 6:
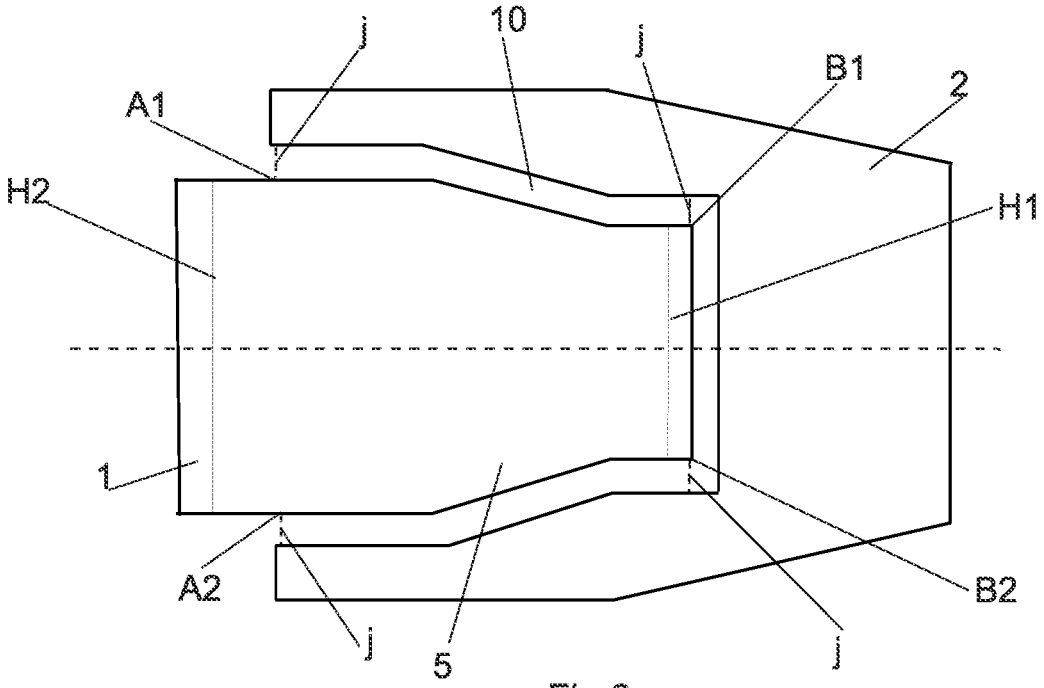
FIG. 6 shows a schematic view of a section according to plane XY of the assembly formed by an adapter and a wear element.

FIG. 6 shows a schematic view of a section according to plane XY of the assembly formed by an adapter 1 and a wear element 2. Points A1, A2, B1, and B2 of the adapter 1 and clearance j have been indicated. Points a1, a2, b1, and b2 of the wear element 2 and clearance j could similarly be depicted.

Figure 7:
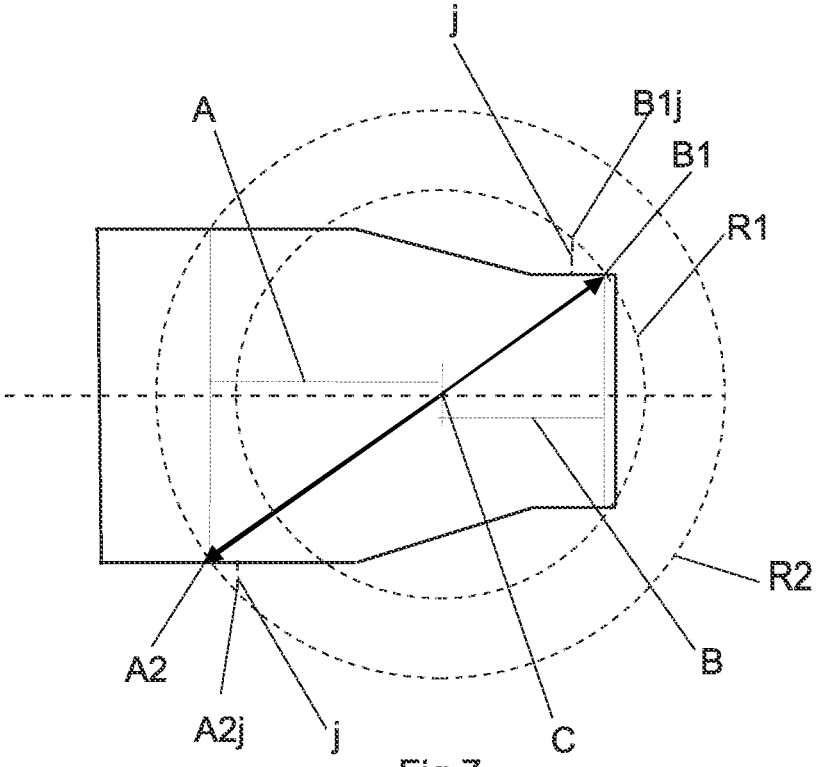
FIG. 7 shows a schematic view of a section according to plane XY of the adapter of FIG. 6, and the movement performed by points B1 and A2 during a rotation.

When the adapter 1 is subjected to a rotation in the counterclockwise direction with respect to the wear element 2 (assume, for example, that the wear element 2 is driven into the ground and that in an attempt to move the shovel, this rotation of the adapter 1 with respect to the wear element 2 is caused), point B1 will move up to a height j, at which time it will collide with the wear element 2, at point B1j. This upward movement will be along an arc with radius R1 and center C. In turn, point A2 will move down by a height j following an arc with radius R2 and center C until reaching point A2j. Through symmetry (the support surfaces are symmetrical with respect to plane XZ), points B2j and A1j are also present, and point C is known to be at a point of axis X. FIG. 7 shows these elements. Distances A and B are also shown.

However, according to the invention it is of interest for arc B1CB1j to be equal to arc A2CA2j. The two points will thereby contact one another simultaneously, which will reduce the stresses the pin must withstand. Therefore, the following holds $$\arcsin\left(\frac{H1/2+j}{R1}\right)-\arcsin\left(\frac{H1/2}{R1}\right)=\arcsin\left(\frac{H2/2}{R2}\right)-\arcsin\left(\frac{H2/2-j}{R2}\right)$$

The most practical way to solve this equation is by iterations.

The equivalent formula for a wear element 2 can similarly be calculated:

$$\arcsin\left(\frac{h1/2}{r1}\right)-\arcsin\left(\frac{h1/2-j}{r1}\right)=\arcsin\left(\frac{h2/2}{r2}\right)-\arcsin\left(\frac{h2/2-j}{r2}\right)$$

Figure 8:
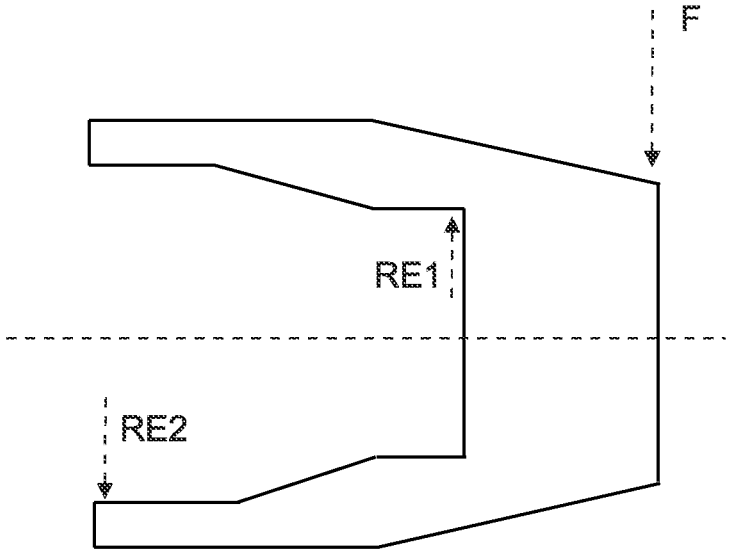
FIG. 8 shows a schematic view of a section according to plane XY of a wear element without lugs.
Figure 9:
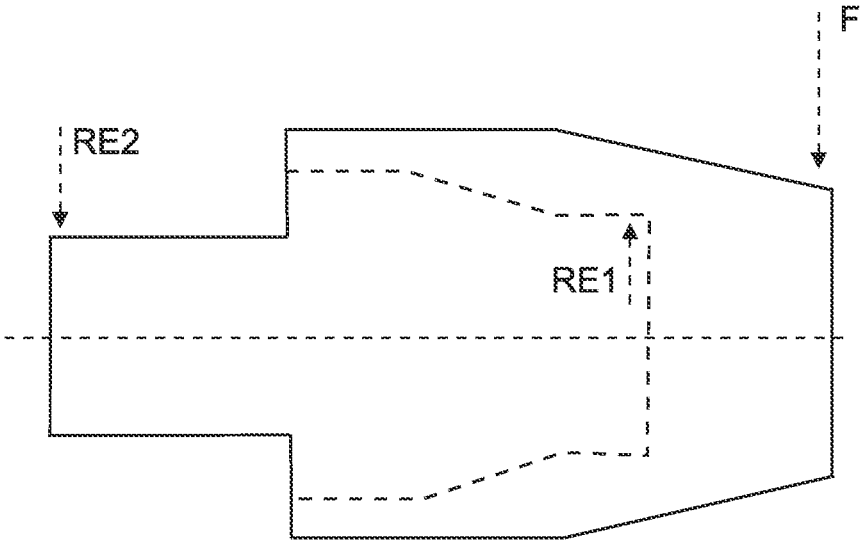
FIG. 9 shows a schematic side elevational view of a wear element with lugs.

FIGS. 8 and 9 schematically show a wear element 2 without lugs and another one with lugs, respectively. Reactions RE1 and RE2 that occur, and their points of application when a force F is applied at the tip of the wear element 2 are also shown.

Figure 10:
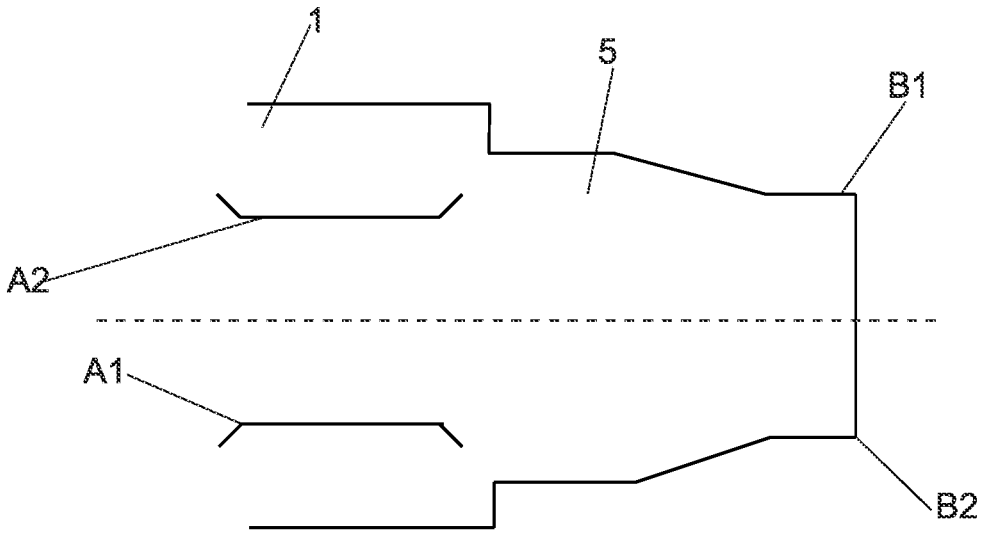
FIG. 10 shows a schematic side elevational view of an adapter for a wear element with lugs, with points A1, A2, B1, and B2 being marked.
Figure 11:
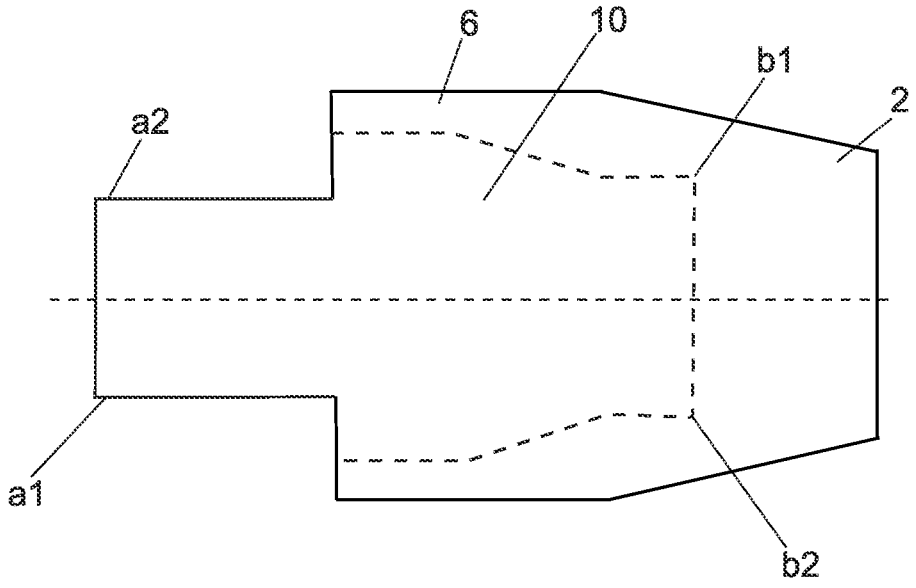
FIG. 11 shows a schematic side elevational view of a wear element with lugs, with points a1, a2, b1, and b2 being marked.

In the case of a wear assembly in which the wear element 2 has lugs, the position of points A1, A2, B1, B2, a1, a2, b1, and b2 is the one shown in FIGS. 10 and 11. Applying the same reasoning as that applied in the case of a wear assembly without lugs leads to the following formulas:

for the adapter 1:

$$\arcsin\left(\frac{H1/2+j}{R1}\right)-\arcsin\left(\frac{H1/2}{R1}\right)=\arcsin\left(\frac{H2/2}{R2}\right)-\arcsin\left(\frac{H2/2-j}{R2}\right)$$

for the wear element 2 with lugs:

$$\arcsin\left(\frac{h1/2}{r1}\right)-\arcsin\left(\frac{h1/2-j}{r1}\right)=\arcsin\left(\frac{h2/2+j}{r2}\right)-\arcsin\left(\frac{h2/2}{r2}\right)$$

Figure 12:
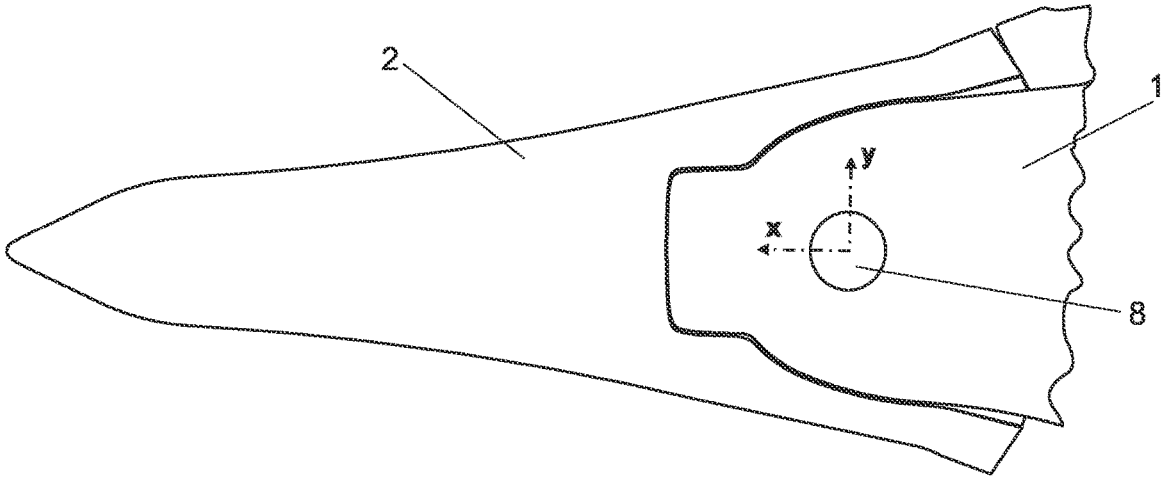
FIGS. 12 to 15 show schematic views of sections according to plane XY of four wear assemblies with different fronts.

Numerical simulations of four wear assemblies have been performed in which the adapter 1 has different surfaces between the front end of the front upper support surface and the front end of the front lower support surface. In each case, the wear element 2 has an equivalent surface inside its cavity 10. In all cases, the clearance j was 0.5 mm and the direct load applied was 10000 N. The following results were obtained:

Frontal Plane (FIG. 12)
- X pin reaction: 7040 N
- Y pin reaction: 12845 N
- Total pin reaction: 14648 N
- Reaction/load: 146%
- X reaction/load: 70%

Figure 13:
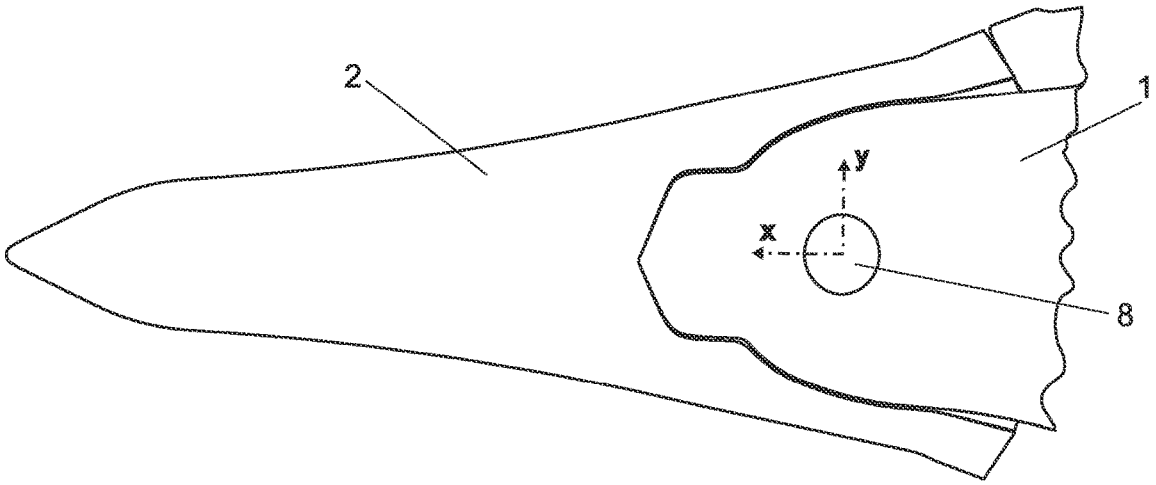

Symmetrical Angled Front (FIG. 13)
- X pin reaction: 3127 N
- Y pin reaction: 14068 N
- Total pin reaction: 14411 N
- Total reaction/load: 144%
- X reaction/load: 31%

Figure 14:
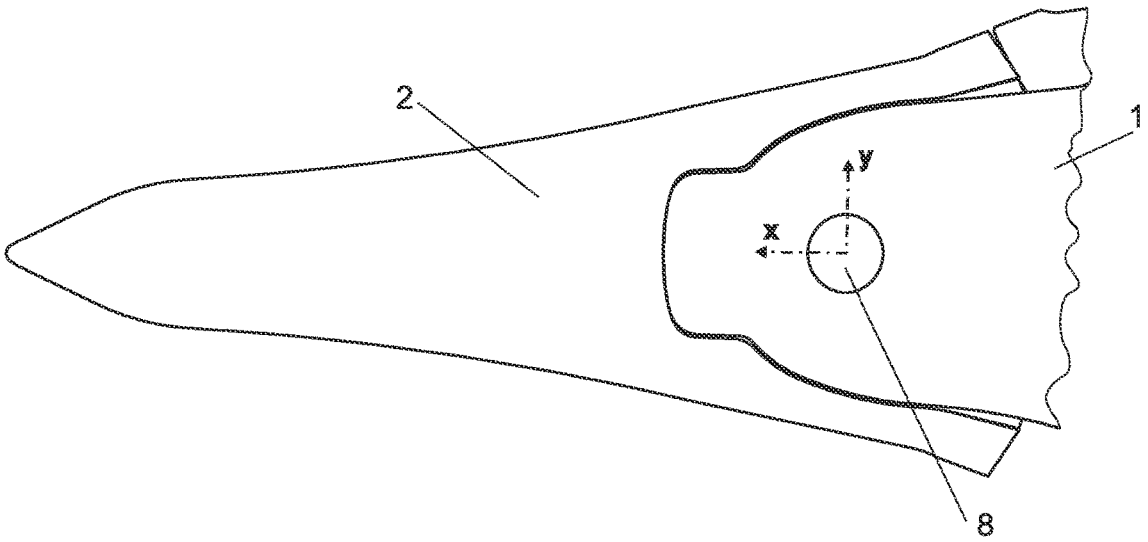

Rounded Front (FIG. 14)
- X pin reaction: 4698 N
- Y pin reaction: 12475 N
- Total pin reaction: 13330 N
- Reaction/load: 133%
- X reaction/load: 47%

Figure 15:
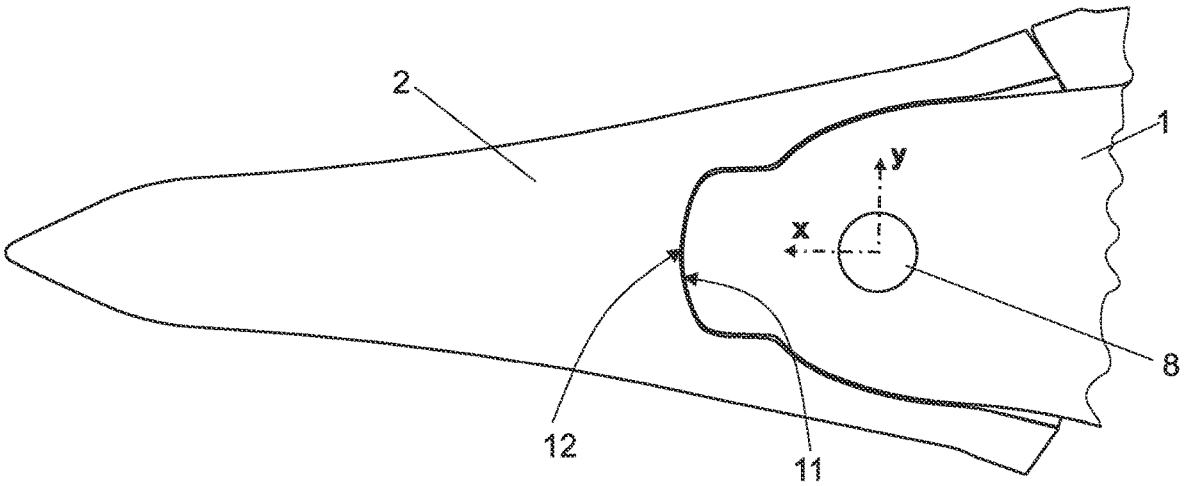

Front with Hemispherical Surface (11, 12) with Center C (Coinciding with Center c) and Radius R1 (Equal to r1) (FIG. 15)
- X pin reaction: 2362 N
- Y pin reaction: 14073 N
- Total pin reaction: 14270 N
- Reaction/load: 143%
- X reaction/load: 24%

It can be observed that the flat front surface (FIG. 12) is the least favorable of all. In turn, the hemispherical front surface (11, 12) has the smallest reaction according to axis X.

Figure 16:
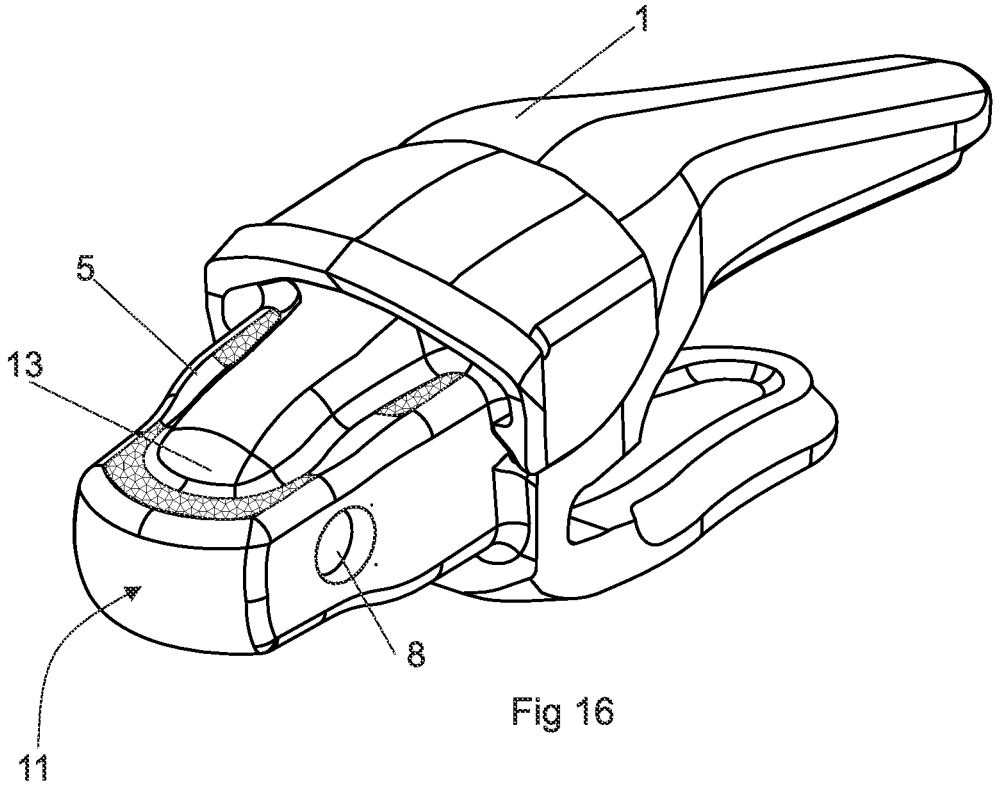
FIG. 16 show a top front perspective view of an adapter according to the invention.
Figure 17:
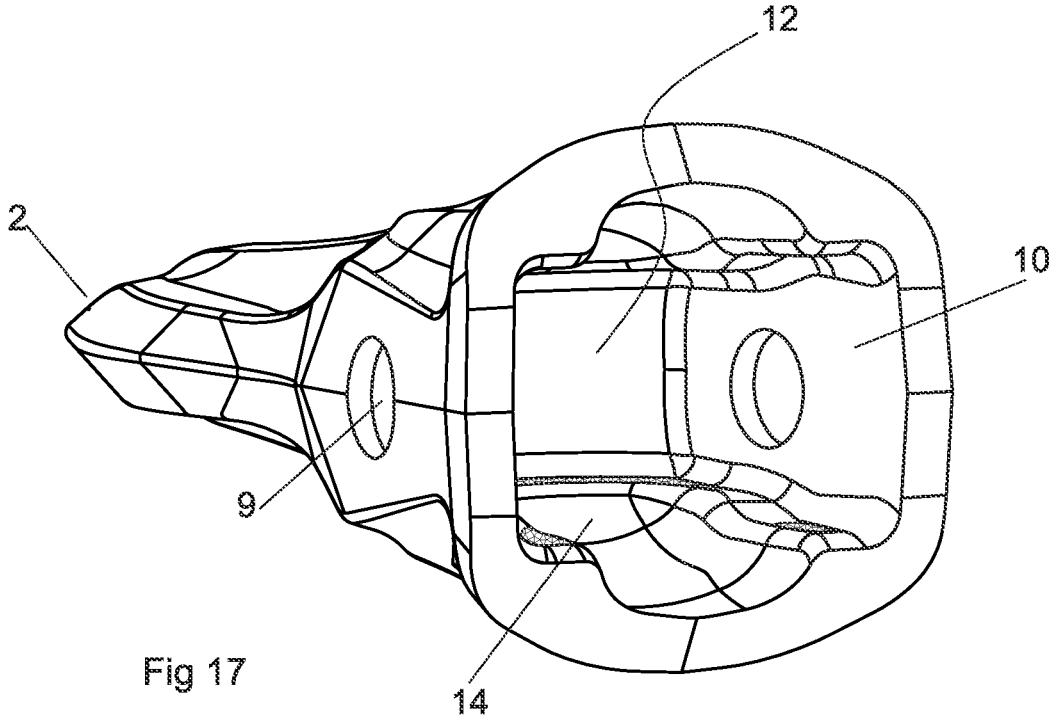
FIG. 17 shows a top rear perspective view of a wear element, specifically a tooth, according to the invention.

FIG. 16 shows an adapter 1 according to the invention. The areas corresponding to the front upper support surface (having only one C-shaped surface) and to the rear upper support surfaces (having two, one on each side of the adapter) have been marked with shading. FIG. 17 shows a wear element 2 (namely, a tooth), suitable for being assembled in the adapter 1 of FIG. 16. The front lower support surface and the lower rear support surfaces of the tooth 2 can be observed in the cavity 10 of the tooth 2 (also shaded). The tooth 2 of FIG. 17 is a tooth without lugs and it can be seen that h2 is greater than h1. Similarly, in the adapter H2 is greater than H1. In the adapter 1, a hemispherical surface 11 with center C and radius R1 extends between the front end of the front upper support surface and the front end of the front lower support surface. In turn, in the tooth 2 a hemispherical surface 12 with center c and radius r1 extends between the front end of the front upper support surface and the front end of the front lower support surface. Both radii R1 and r1 are identical, and when the tooth 2 is assembled on the adapter 1, center C and center c coincide, so the two hemispherical surfaces 11 and 12 overlap and coincide with one another. The existence of a secondary hemispherical surface 13 with center C in the adapter 1 (it has another identical one in the lower part), and a secondary hemispherical surface 14 with center c in the cavity 10 of the tooth 2 (there is another identical one in the upper part of the cavity 10) can also be observed. In rotation of the tooth 2, since the two secondary hemispherical surfaces 13 and 14 (the one of the tooth 2 and the one of the adapter 1 (also referred to as tooth bar)) are concentric spherical surfaces, during the relative movement of one surface with respect to the other surface, the hollow space between both does not increase, so the entry of material is restricted/limited. This has the advantage of the removal forces pressing on the pin 8 being stabilized.

The invention claimed is:

1. An adapter for supporting a wear element of a shovel of an earth moving machine, comprising:

said adapter has a rear part suitable for being fixed to said shovel, and a front part suitable for being housed inside a cavity of said wear element, wherein said adapter defines a longitudinal axis X, has at least one pin opening suitable for housing a pin suitable for retaining said wear element on said adapter, wherein said pin has a pre-established location with respect to said pin opening and has a longitudinal axis defining an axis Z, wherein said axis X and said axis Z define a plane XZ and a direction perpendicular to said plane XZ, defining an axis Y, and said axis X and said axis Y define a plane XY, has at least one front upper support surface, at least one rear upper support surface, at least one front lower support surface, and at least one rear lower support surface, said upper support surfaces and said lower support surfaces are symmetrical to one another with respect to said plane XZ, in a longitudinal section according to plane XY, the following is defined:

a point A1 which is the rear end of the intersection of the rear upper support surface with said plane XY or, if there is more than one rear upper support surface, it is the projection according to Z on said plane XY of the most rearward end of all the rear upper support surfaces, a point A2 which is the rear end of the intersection of the rear lower support surface with said plane XY or, if there is more than one rear lower support surface, it is the projection according to Z on said plane XY of the most rearward end of all the rear lower support surfaces, a point B1 which is the front end of the intersection of the front upper support surface with said plane XY or, if there is more than one front upper support surface, it is the projection according to Z on said plane XY of the most forward end of all the front upper support surfaces, a point B2 which is the front end of the intersection of the front lower support surface with said plane XY or, if there is more than one front lower support surface, it is the projection according to Z on said plane XY of the most forward end of all the front lower support surfaces, wherein between A1 and A2 there is a distance H2 in direction Y, and between B1 and B2 there is a distance H1 in direction Y, wherein when said wear element (2) is assembled on said adapter (1), there is a clearance, in the direction of axis Y, between any of said points A1, A2, B1, and B2 and said wear element (2) with a predetermined value j, wherein between A1 and B1 there is a distance D in direction X, wherein said axis Z passes through the inside of a circle arranged in said longitudinal section, with radius R and center C, wherein said center C is arranged on said axis X, wherein R2 is a radius with an origin at center C and end at A1, wherein A1j is a point arranged at a distance R2 from center C and at a distance from axis X, according to the direction of Y, equal to $$\frac{H2}{2} + j,$$

wherein R1 is a radius with an origin at center C and end at B1, wherein B1j is a point arranged at a distance R1 from center C and at a distance from axis X, according to the direction of Y, equal to $$\frac{H1}{2} + j,$$

wherein between A1 and C there is a distance A in direction X, and between B1 and C there is a distance B in direction X, and wherein if said adapter is for a wear element-without lugs $$\arcsin\left(\frac{H1/2 + j}{R1}\right)\arcsin\left(\frac{H1/2}{R1}\right) - \arcsin\left(\frac{H2/2 + j}{R2}\right)\arcsin\left(\frac{H2/2}{R2}\right)$$

whereas if said adapter is for a wear element with lugs $$\arcsin\left(\frac{H1/2 + j}{R1}\right) - \arcsin\left(\frac{H1/2}{R1}\right) = \arcsin\left(\frac{H2/2}{R2}\right) - \arcsin\left(\frac{H2/2 - j}{R2}\right).$$

2. The adapter according to claim 1, wherein said radius R has a value less than 10% of the sum of distances A and B, and preferably has a value less than 5% of the sum of distances A and B.

3. The adapter according to claim 1, wherein a hemispherical surface with center C and radius R1 extends between [a] the front end of the front upper support surface or, if there is more than one front upper support surface, between the front most forward end of all the front upper support surfaces, and [b] the front end of the front lower support surface or, if there is more than one front lower support surface, between the front most forward end of all the front lower support surfaces.

4. The adapter according to claim 1, wherein said adapter comprises at least one upper secondary hemispherical surface, the center of which is at C, and one lower secondary hemispherical surface, the center of which is also at C.

5. The adapter according to claim 1, wherein said adapter is for a wear element without lugs.

6. The adapter according to claim 5, wherein H2 is greater than H1.

7. A wear element suitable for being assembled on an adapter of a shovel of an earth moving machine comprising:

said wear element has a front part suitable for cutting into the earth to be moved, and a rear part with a cavity suitable for housing therein a front part of said adapter, wherein said wear element defines a longitudinal axis X, has at least one through opening on one side of said cavity, suitable for housing a pin suitable for retaining said wear element on said adapter, wherein said pin has a pre-established location with respect to said through opening and has a longitudinal axis defining an axis Z, wherein said axis X and said axis Z define a plane XZ and a direction perpendicular to said plane XZ, defining an axis Y, and said axis X and said axis Y define a plane XY, has at least one front upper support surface, at least one rear upper support surface, at least one front lower support surface, and at least one rear lower support surface, said upper support surfaces and said lower support surfaces are symmetrical to one another with respect to said plane XZ, in a longitudinal section according to plane XY, the following is defined:

a point a1 which is the rear end of the intersection of the rear upper support surface with said plane XY or, if there is more than one rear upper support surface, it is the projection according to Z on said plane XY of the most rearward end of all the rear upper support surfaces, a point a2 which is the rear end of the intersection of the rear lower support surface with said plane XY or, if there is more than one rear lower support surface, it is the projection according to Z on said plane XY of the most rearward end of all the rear lower support surfaces, a point b1 which is the front end of the intersection of the front upper support surface with said plane XY or, if there is more than one front upper support surface, it is the projection according to Z on said plane XY of the most forward end of all the front upper support surfaces, a point b2 which is the front end of the intersection of the front lower support surface with said plane XY or, if there is more than one front lower support surface, it is the projection according to Z on said plane XY of the most forward end of all the front lower support surfaces, wherein between a1 and a2 there is a distance h2 in direction Y, and between b1 and b2 there is a distance h1 in direction Y, wherein when said wear element is assembled on said adapter, there is a clearance, in the direction of axis Y, between any of said points a1, a2, b1, and b2 and said adapter with a predetermined value j, wherein between a1 and b1 there is a distance d in direction X, wherein said axis Z passes through the inside of a circle arranged in said longitudinal section, with radius r and center c, wherein said center c is arranged on said axis X, wherein r2 is a radius with an origin at center c and end at a1, wherein a1j is a point arranged at a distance r2 from center c and at a distance from axis X, according to the direction of Y, equal to $$\frac{h2}{2} - j,$$

wherein r1 is a radius with an origin at center c and end at b1, wherein b1j is a point arranged at a distance r1 from center c and at a distance from axis X, according to the direction of Y, equal to $$\frac{h1}{2} - j,$$

wherein between a1 and c there is a distance a in direction X, and between b1 and c there is a distance b in direction X, and wherein if said wear element is a wear element without lugs $$\arcsin\left(\frac{h1/2}{r1}\right) - \arcsin\left(\frac{h1/2 - j}{r1}\right) = \arcsin\left(\frac{h2/2}{r2}\right) - \arcsin\left(\frac{h2/2 - j}{r2}\right)$$

whereas if said wear element is a wear element with lugs $$\arcsin\left(\frac{h1/2}{r1}\right) - \arcsin\left(\frac{h1/2 - j}{r1}\right) = \arcsin\left(\frac{h2/2 + j}{r2}\right) - \arcsin\left(\frac{h2/2}{r2}\right).$$

8. The wear element according to claim 7, wherein said radius r has a value less than 10% of the sum of distances a and b, and preferably has a value less than 5% of the sum of distances a and b.

9. The wear element according to claim 7, wherein a hemispherical surface with center c and radius r1 extends between [a] the front end of the front upper support surface or, if there is more than one front upper support surface, between the front most forward end of all the front upper support surfaces, and [b] the front end of the front lower support surface or, if there is more than one front lower support surface, between the front most forward end of all the front lower support surfaces.

10. The wear element according to claim 7, wherein said wear element comprises at least one upper secondary hemispherical surface, the center of which is at c, and one lower secondary hemispherical surface, the center of which is also at c.

11. The wear element according to claim 7, wherein said wear element is a wear element without lugs.

12. The wear element according to claim 11, wherein h2 is greater than h1.

13. An assembly formed by an adapter according to claim 1 and a wear element suitable for being assembled on an adapter of a shovel of an earth moving machine comprising:

said wear element has a front part suitable for cutting into the earth to be moved, and a rear part with a cavity suitable for housing therein a front part of said adapter, wherein said wear element defines a longitudinal axis X, has at least one through opening on one side of said cavity, suitable for housing a pin suitable for retaining said wear element on said adapter, wherein said pin has a pre-established location with respect to said through opening and has a longitudinal axis defining an axis Z, wherein said axis X and said axis Z define a plane XZ and a direction perpendicular to said plane XZ, defining an axis Y, and said axis X and said axis Y define a plane XY, has at least one front upper support surface, at least one rear upper support surface, at least one front lower support surface, and at least one rear lower support surface, said upper support surfaces and said lower support surfaces are symmetrical to one another with respect to said plane XZ, in a longitudinal section according to plane XY, the following is defined:

a point a1 which is the rear end of the intersection of the rear upper support surface with said plane XY or, if there is more than one rear upper support surface, it is the projection according to Z on said plane XY of the most rearward end of all the rear upper support surfaces, a point a2 which is the rear end of the intersection of the rear lower support surface with said plane XY or, if there is more than one rear lower support surface; it is the projection according to Z on said plane XY of the most rearward end of all the rear lower support surfaces:

a point b1 which is the front end of the intersection of the front upper support surface with said plane XY or, if there is more than one front upper support surface, it is the projection according to Z on said plane XY of the most forward end of all the front upper support surfaces, a point b2 which is the front end of the intersection of the front lower support surface with said plane XY or, if there is more than one front lower support surface, it is the projection according to Z on said plane XY of the most forward end of all the front lower support surfaces;

wherein between a1 and a2 there is a distance h2 in direction Y, and between b1 and b2 there is a distance h1 in direction Y, wherein when said wear element is assembled on said adapter, there is a clearance, in the direction of axis Y, between any of said points a1, a2, b1, and b2 and said adapter with a predetermined value j, wherein between a1 and b1 there is a distance d in direction X, wherein said axis Z passes through the inside of a circle arranged in said longitudinal section, with radius r and center c, wherein said center c is arranged on said axis X, wherein r2 is a radius with an origin at center c and end at a1, wherein a1j is a point arranged at a distance r2 from center c and at a distance from axis X, according to the direction of Y, equal to $$\frac{h2}{2} - j,$$

wherein r1 is a radius with an origin at center c and end at b1, wherein b1i is a point arranged at a distance r1 from center c and at a distance from axis X, according to the direction of Y, equal to $$\frac{h1}{2} - j,$$

wherein between a1 and c there is a distance a in direction X, and between b1 and c there is a distance b in direction X, and wherein if said wear element is a wear element without lugs $$\arcsin\left(\frac{h1/2}{r1}\right) - \arcsin\left(\frac{h1/2 - j}{r1}\right) = \arcsin\left(\frac{h2/2}{r2}\right) - \arcsin\left(\frac{h2/2 - j}{r2}\right)$$

whereas if said wear element is a wear element with lugs $$\arcsin\left(\frac{h1/2}{r1}\right) - \arcsin\left(\frac{h1/2 - j}{r1}\right) = \arcsin\left(\frac{h2/2 + j}{r2}\right) - \arcsin\left(\frac{h2/2}{r2}\right).$$

14. The assembly according to claim 13, wherein the value of radius R1 is equal to the value of radius r1.

15. A method of designing an adapter for supporting a wear element of a shovel of an earth moving machine, wherein:

said adapter has a rear part suitable for being fixed to said shovel, and a front part suitable for being housed inside a cavity of said wear element, wherein said adapter defines a longitudinal axis X, said method comprising a step of locating at least one pin opening suitable for housing a pin suitable for retaining said wear element on said adapter, wherein said pin has a longitudinal axis defining an axis Z, wherein said axis X and said axis Z define a plane XZ and a direction perpendicular to said plane XZ, defining an axis Y, and said axis X and said axis Y define a plane XY, wherein said adapter has at least one front upper support surface, at least one rear upper support surface, at least one front lower support surface, and at least one rear lower support surface, wherein said upper support surfaces and said lower support surfaces are symmetrical to one another with respect to said plane XZ, wherein in a longitudinal section according to plane XY, the following is defined:

a point A1 which is the rear end of the intersection of the rear upper support surface with said plane XY or, if there is more than one rear upper support surface, it is the projection according to Z on said plane XY of the most rearward end of all the rear upper support surfaces, a point A2 which is the rear end of the intersection of the rear lower support surface with said plane XY or, if there is more than one rear lower support surface, it is the projection according to Z on said plane XY of the most rearward end of all the rear lower support surfaces, a point B1 which is the front end of the intersection of the front upper support surface with said plane XY or, if there is more than one front upper support surface, it is the projection according to Z on said plane XY of the most forward end of all the front upper support surfaces, a point B2 which is the front end of the intersection of the front lower support surface with said plane XY or, if there is more than one front lower support surface, it is the projection according to Z on said plane XY of the most forward end of all the front lower support surfaces, wherein between A1 and A2 there is a distance H2 in direction Y, and between B1 and B2 there is a distance H1 in direction Y, wherein when said wear element is assembled on said adapter, there is a clearance, in the direction of axis Y, between any of said points A1, A2, B1, and B2 and said wear element with a predetermined value j, wherein between A1 and B1 there is a distance D in direction X, and wherein said axis Z is positioned such that it passes through the inside of a circle arranged in said longitudinal section, with radius R and center C, wherein said center C is arranged on said axis X, wherein R2 is a radius with an origin at center C and end at A1, wherein A1j is a point arranged at a distance R2 from center C and at a distance from axis X, according to the direction of Y, equal to $$\frac{H2}{2}+j,$$

wherein R1 is a radius with an origin at center C and end at B1, wherein B1j is a point arranged at a distance RI from center C and at a distance from axis X, according to the direction of Y, equal to $$\frac{H1}{2}+j,$$

wherein between A1 and C there is a distance A in direction X, and between B1 and C there is a distance B in direction X, and wherein if said adapter is for a wear element without lugs $$\arcsin\left(\frac{H1/2+j}{R1}\right)-\arcsin\left(\frac{H1/2}{R1}\right)=\arcsin\left(\frac{H2/2+j}{R2}\right)-\arcsin\left(\frac{H2/2}{R2}\right)$$

whereas if said adapter is for a wear element with lugs $$\arcsin\left(\frac{H1/2+j}{R1}\right)-\arcsin\left(\frac{H1/2}{R1}\right)=$$

-continued $$\arcsin\left(\frac{H2/2}{R2}\right)-\arcsin\left(\frac{H2/2-j}{R2}\right).$$

16. A method of manufacturing an adapter for supporting a wear element of a shovel of an earth moving machine, wherein:

said adapter has a rear part suitable for being fixed to said shovel, and a front part suitable for being housed inside a cavity of said wear element, wherein said adapter defines a longitudinal axis X, comprising a step of designing an adapter according to claim 15, a step of manufacturing a mold comprising the geometry suitable for forming said pin opening suitable for housing a pin suitable for retaining said wear element on said adapter, wherein said pin has a longitudinal axis defining said axis Z, and a step of pouring molten material into said mold for obtaining said adapter.

17. A method of designing a wear element suitable for being assembled on an adapter of a shovel of an earth moving machine, wherein:

said wear element has a front part suitable for cutting into the earth to be moved, and a rear part with a cavity suitable for housing therein a front part of said adapter, wherein said wear element defines a longitudinal axis X, said method comprising a step of locating at least one through opening on one side of said cavity, suitable for housing a pin suitable for retaining said wear element on said adapter, wherein said pin has a longitudinal axis defining an axis Z, wherein said axis X and said axis Z define a plane XZ and a direction perpendicular to said plane XZ, defining an axis Y, and said axis X and said axis Y define a plane XY, wherein said wear element has at least one front upper support surface, at least one rear upper support surface, at least one front lower support surface, and at least one rear lower support surface, wherein said upper support surfaces and said lower support surfaces are symmetrical to one another with respect to said plane XZ, wherein in a longitudinal section according to plane XY, the following is defined:

a point a1 which is the rear end of the intersection of the rear upper support surface with said plane XY or, if there is more than one rear upper support surface, it is the projection according to Z on said plane XY of the most rearward end of all the rear upper support surfaces, a point a2 which is the rear end of the intersection of the rear lower support surface with said plane XY or, if there is more than one rear lower support surface, it is the projection according to Z on said plane XY of the most rearward end of all the rear lower support surfaces, a point b1 which is the front end of the intersection of the front upper support surface with said plane XY or, if there is more than one front upper support surface, it is the projection according to Z on said plane XY of the most forward end of all the front upper support surfaces, a point b2 which is the front end of the intersection of the front lower support surface with said plane XY or, if there is more than one front lower support surface, it is the projection according to Z on said plane XY of the most forward end of all the front lower support surfaces, wherein between a1 and a2 there is a distance h2 in direction Y, and between b1 and b2 there is a distance h1 in direction Y, wherein when said wear element is assembled on said adapter, there is a clearance, in the direction of axis Y, between any of said points a1, a2, b1, and b2 and said adapter with a predetermined value j, wherein between a1 and b1 there is a distance d in direction X, and wherein said axis Z is positioned to pass through the inside of a circle arranged in said longitudinal section, with radius r and center c, wherein said center c is arranged on said axis X, wherein r2 is a radius with an origin at center c and end at a1, wherein a1j is a point arranged at a distance r2 from center c and at a distance from axis X, according to the direction of Y, equal to $$\frac{h2}{2} - j,$$

wherein r1 is a radius with an origin at center c and end at b1, wherein b1j is a point arranged at a distance r1 from center c and at a distance from axis X, according to the direction of Y, equal to $$\frac{h1}{2} - j,$$

wherein between a1 and c there is a distance a in direction X, and between b1 and c there is a distance b in direction X, and wherein if said wear element is a wear element without lugs $$\arcsin\left(\frac{h1/2}{r1}\right) - \arcsin\left(\frac{h1/2 - j}{r1}\right) = \arcsin\left(\frac{h2/2}{r2}\right) - \arcsin\left(\frac{h2/2 - j}{r2}\right)$$

whereas if said wear element is a wear element with lugs $$\arcsin\left(\frac{h1/2}{r1}\right) - \arcsin\left(\frac{h1/2 - j}{r1}\right) = \arcsin\left(\frac{h2/2 + j}{r2}\right) - \arcsin\left(\frac{h2/2}{r2}\right).$$

18. A method of manufacturing a wear element suitable for being assembled on an adapter of a shovel of an earth moving machine, wherein:

said wear element is a wear element without lugs, said wear element has a front part suitable for cutting into the earth to be moved, and a rear part with a cavity suitable for housing therein a front part of said adapter, wherein said wear element defines a longitudinal axis X, comprising a step of designing a wear element according to claim 17, a step of manufacturing a mold comprising the geometry suitable for forming said through opening suitable for housing a pin suitable for retaining said wear element on said adapter, wherein said pin has a longitudinal axis defining said axis Z, and a step of pouring molten material into said mold for obtaining said wear element.

* * * * *